United States Patent [19]

Down

[11] Patent Number: 4,519,837

[45] Date of Patent: May 28, 1985

[54] METAL POWDERS AND PROCESSES FOR PRODUCTION FROM OXIDES

[75] Inventor: Michael G. Down, Pittsburgh, Pa.

[73] Assignee: Westinghouse Electric Corp., Pittsburgh, Pa.

[21] Appl. No.: 604,398

[22] Filed: Apr. 26, 1984

Related U.S. Application Data

[63] Continuation of Ser. No. 309,863, Oct. 8, 1981, abandoned.

[51] Int. Cl.[3] ..... B22F 9/00

[52] U.S. Cl. ..... 75/0.5 B; 75/0.5 BA; 75/0.5 BB; 75/0.5 BC

[58] Field of Search ..... 75/0.5 B, 0.5 BA, 0.5 BB, 75/0.5 BC, 251-255

[56] References Cited

U.S. PATENT DOCUMENTS

| | | | |
|---|---|---|---|
| 2,984,560 | 5/1961 | Dombrowski | 75/251 |
| 3,990,862 | 11/1976 | Dahl et al. | 428/613 |
| 4,356,029 | 10/1984 | Down et al. | 75/0.5 BB |

FOREIGN PATENT DOCUMENTS

| | | | |
|---|---|---|---|
| 729503 | 5/1955 | United Kingdom . | |
| 729504 | 5/1955 | United Kingdom . | |
| 755083 | 8/1956 | United Kingdom . | |
| 795162 | 5/1958 | United Kingdom . | |
| 1141775 | 1/1969 | United Kingdom | 75/251 |
| 1549702 | 8/1979 | United Kingdom . | |

OTHER PUBLICATIONS

Jaffee, R. I., et al.; *Titanium Science and Technology*, pp. 261-269, 381-390, 396, 398, (1972).

Henderson, J. G.; et al., *Metallurgical Dictionary*, pp. 301, 302, (1953).

Friedman, G., "Titanium Powder Metallurgy", International Journal of Powder Metallurgy, 6, (2), 1970, pp. 43-55.

Powder Metallurgy of Titanium Alloys, Ed. by Froes; F. et al., (1980), pp. 1-19, 71-81, 175-187; The Met. Soc. of the A.I.M.E.

*Primary Examiner*—Wayland Stallard

*Attorney, Agent, or Firm*—John J. Prizzi

[57] ABSTRACT

Method of forming metal powders from the liquid metal reduction of metal oxides are described. The methods described include the steps of low temperature liquid metal reduction of the oxide, agitation of the reduction reaction mixture and/or distillation of excess reductant upon completion of the reduction step. These steps are designed to limit agglomeration and enhance the purity of the final powder produced. Metal powder produced in accordance with this invention has a basic particle size of 0.1 to 0.5 microns.

15 Claims, 2 Drawing Figures

METAL POWDERS AND PROCESSES FOR PRODUCTION FROM OXIDES

This application is a continuation, of application Ser. No. 309,863, filed Oct. 8, 1981, and now abandoned.

BACKGROUND OF THE INVENTION

The present invention relates to the fields of metal oxide reduction to metal powder through the use of a liquid metal reducing agent. It especially relates to the reduction of the oxides of reactive metals, such as titanium, hafnium and zirconium.

In the past the difficult to reduce oxides of the metals titanium, zirconium, thorium, uranium, vanadium, etc. have been reduced by a liquid metal reducing agent as described in U.S. Pat. Nos. 1,573,083; 1,704,257; 1,814,719; 2,446,062; 2,537,068; 2,653,869; and 2,707,679. While other reducing agents have been utilized liquid calcium has been typically preferred because of its oxide's very negative free energy of formation.

However the use of liquid calcium as a reducing agent has been limited to temperatures above 850° C., the melting point of pure calcium. The actual reduction temperatures taught by previous investigators has ranged from approximately 900° C. to 1350° C. These high reduction temperatures in combination with localized high temperatures generated by the heat released by the reduction reaction itself have tended to cause agglomeration of the powders produced. These powder agglomerates are deleterious in that they can entrap calcium oxide, calcium and other impurities which are difficult to remove by the leaching techniques used to clean the metal powders.

SUMMARY OF THE INVENTION

According to one embodiment of the present invention a metal oxide is reduced to a substantially unoxidized metal by the action of a quantity of liquid metal reducing agent in excess of that stoichiometrically required to fully reduce the metal oxide. During the reduction reaction the reaction mixture of metal oxide and reducing agent is agitated or stirred to reduce the number and/or size of metal powder agglomerates formed.

According to another aspect of the present invention the metal oxide is reduced at a temperature below approximately 600° C. The liquid metal reducing agent utilized is selected from the group of lithium, lithium-sodium, lithium-magnesium, and lithium-calcium. Preferably the reaction mixture is stirred during reduction.

In another embodiment of the present invention after the reduction of the metal oxide by an excess quantity of the liquid metal reducing agent has taken place the excess liquid metal then remaining is distilled off. Preferably the liquid metal reducing agent is lithium.

In the most preferred embodiment of the present invention a mixture of titanium oxide and liquid lithium, in a quantity in excess of that stoichiometrically required to fully reduce the titanium oxide, is formed. The reduction reaction takes place at a temperature between approximately 350° and 600° C. under an inert atmosphere until the titanium oxide has been substantially reduced to the unoxidized metal. The excess lithium is then vacuum distilled from the mixture leaving titanium powder and lithium oxide powder. During the reduction and distillation steps of the process the mixture is stirred to limit powder particle agglomeration. After distillation the lithium oxide and any remaining lithium metal are leached from the titanium powder and the resulting titanium powder washed and dried.

The above processing according to the present invention results in a metal powder having a basic particle size of approximately 0.1 to approximately 0.5 microns which may be used in the manufacture of powder metal parts or as a gettering material.

These and other aspects of the present invention will become more apparent upon review of the drawings in conjunction with the following detailed description of the invention.

DETAILED DESCRIPTION OF THE INVENTION

Figure 1:
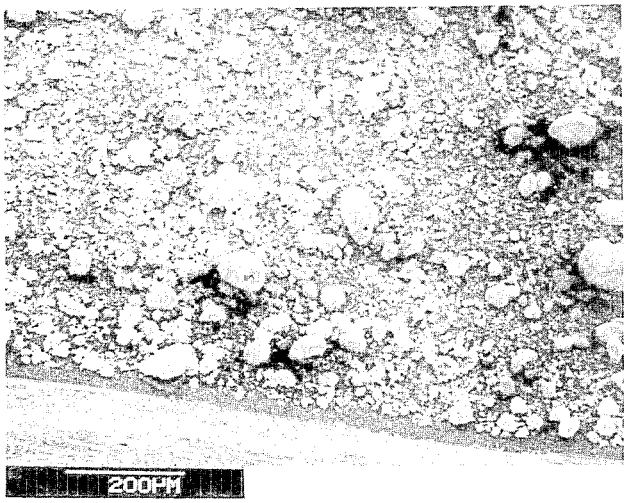
FIG. 1 is a scanning electron micrograph of titanium powder produced directly from titanium dioxide in accordance with the present invention.

In accordance with the present invention lithium is the most preferred liquid metal reducing agent. It is most preferred in that it has a low melting temperature of approximately 180° C. which allows low reduction temperatures between 350° C. and 600° C. to be used in reducing the oxides of the transition metals. All transition metals except for zirconium, hafnium, thorium, lanthanum, uranium, scandium and yttrium can be reduced by this liquid metal reduction process using lithium. A lithium-magnesium solution containing up to approximately 50% magnesium may substitute for pure lithium. Solutions containing approximately 50% lithium and 50% magnesium have a maximum melting temperature of approximately 270° to 350° C. The aforementioned exceptions are due to the unfavorable thermodynamics of those reduction reactions. Lithium is also preferred in that it can easily be vacuum distilled at 600° C. For the more stable oxides such as those already mentioned, that is, zirconium, hafnium, thorium, lanthanum, uranium, etc., a solution of lithium and calcium may be used. Liquid metal reductant solutions of lithium and calcium can contain up to approximately 75 wt.% calcium and have a melting temperature of approximately 230° C. at the maximum calcium content. These low melting temperatures make liquid reduction of the transition metal oxides possible at a much lower temperature than previously used in prior art liquid calcium reduction operations. According to the present invention a reduction temperature between 600° C. and the melting temperature of the liquid reductant is possible. While pure magnesium which has a melting temperature of 650° C. or pure calcium which has a melting temperature of 850° C. may be used in this invention they are less preferred than the use of pure lithium or lithium magnesium or lithium calcium solutions. The higher temperatures required in using a magnesium or calcium reduction process lead to a greater amount of agglomeration of the metal powder particles produced. This can be alleviated to some extent however by stirring or agitation of the mixture during the reduction process so as to keep the titanium metal particles produced suspended in solution. But the use of these pure high temperature melting metals is clearly less preferred. The reduction of the metal oxides by the liquid metal reductant is thermodynamically achieved by using an amount of reductant in excess of that stoichiometrically required by the reduction chemical equation. While an amount of reductant as low as 200% of that stoichiometrically required can be used in accordance with this invention it is preferable that the liquid reductant be present and at least 1000% of that stoichiometrically required so that not only will the reaction go to completion but the fluidity of bath is enhanced and allows easy stirring of the mixture and contact between the suspended metal particles will be limited. It is also important that the chemistry of both the oxide being reduced and the liquid metal reductant be tightly controlled and should be as pure as possible. This is especially critical with respect to the nitrogen contents in that nitrogen will not be removed by the liquid metal reductant and in fact in many cases will be picked up by the metal which one is trying to produce. In addition the use of metal chlorides should be avoided since these can contaminate the metal powder and be deleterious to its use as a metal powder for powder metallurgical applications. As already mentioned the reaction mixture containing the metal oxide and liquid metal reducing agent should be agitated during the reduction reaction to alleviate the formation of powder agglomerates.

This agitation or stirring can take the form of mechanical means, that is, a stirring implement actually being positioned inside the bath to stir the bath or a vibratory mechanism to vibrate the chamber containing the bath. It can also take the form of a magnetic pump pumping the reaction mixture through the reaction mixture container or a magnetic stirrer stirring the bath without actual contact with the bath. In addition baffles or other impediments may be positioned within the pot containing the bath so as to assist in breaking up agglomerates as they impact against the baffles or impediments.

To further illustrate this invention the following example of a preferred embodiment is provided. 250 grams of high purity lithium is placed inside a stainless steel container. The lithium typically should have a purity of less than 200 ppm nitrogen content. Pigment grade titanium dioxide in the amount of approximately 40 grams is then added to the stainless steel container. In these proportions the lithium is present in approximately 1800% of that stoichiometrically required to reduce the titanium dioxide to titanium metal. The stainless steel container containing these materials is then heated and as the temperature exceeds 180° C. the lithium ingot melts and a suspension of titanium dioxide particles is formed within the mixture as the mixture is stirred. At approximately 350° C. the first noticeable signs of reaction are observed. The reaction mixture is then heated to 500° C. and held there for a few minutes to complete the reduction of the titanium dioxide which proceeds according to the following equation:

$$TiO_2+4Li \rightarrow Ti+2Li_2O$$

Figure 2:
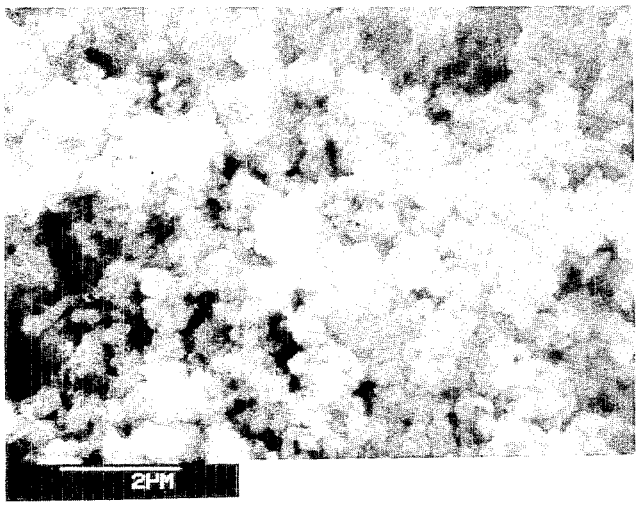
FIG. 2 is a higher magnification view of the powder shown in FIG. 1.

This reduction is performed inside of a glove box holding an argon atmosphere at a pressure slightly in excess of atmospheric pressure. The mixture now containing lithium metal, titanium metal and lithium oxide is then transferred to a vacuum distillation apparatus where the mixture is heated to approximately 600° C. under a $10^{-4}$ torr vacuum. The mixture is agitated during distillation. Substantially all of the lithium metal is distilled from the titanium metal and lithium oxide using this distillation procedure and the lithium metal is recovered on a cold finger extending into the distillation chamber. Titanium powder and lithium oxide powder are left in the stainless steel reaction chamber. The mixture of titanium and lithium oxide powders is then washed with an aqueous medium so as to dissolve the lithium oxide particles and any lithium metal remaining in the mixture. Many solvents including water or mild acids are of course possible, but it should be mentioned that solvents containing chlorides, for example, hydrochloric acid, should be avoided so as to prevent chloride contamination of the titanium powder. After leaching as described above, the titanium powder is washed in deionized water and then dried. Examples of the powder produced are shown in FIGS. 1 and 2 which are scanning electron micrographs of the titanium powder. As can be seen, the titanium powder is composed of particles having a sponge type morphology and are in the form of agglomerates of fine titanium metal particles. In looking at FIG. 2 it can be seen that the powder has a basic particle size of approximately 0.1–0.5 microns. The agglomerates observed in FIG. 1 are made up of these basic particles.

The lithium hydroxide produced by leaching may be treated by $CO_2+CL_2$ according to the following equations to produce lithium chloride. Electrolysis of the lithium chloride may then be performed to recover lithium and chlorine.

| | | | |
|---|---|---|---|
| $2LiOH + CO_2$ | $\rightarrow$ | $Li_2CO_3 + H_2O$ | (1) |
| $Li_2CO_3 + Cl_2$ | $\rightarrow$ | $2LiCl + CO_2 + \frac{1}{2}O_2$ | (2) |
| | electrolysis | | |
| $2LiCl$ | $\rightarrow$ | $2Li + Cl_2$ | (3) |
| | NET REACTION | | |
| $2LiOH$ | $\rightarrow$ | $2Li + H_2O + \frac{1}{2}O_2$ | |

The lithium metal recovered by the above process and through distillation may then be recycled and used to reduce additional oxide material.

Although the invention has been shown in connection with certain specific embodiments it it readily apparent to those skilled in the art that various changes may be made to suit their requirements without departing from the scope of the invention.

What is claimed is:

1. A process for reducing a metal oxide to a substantially unoxidized metal powder, comprising the steps of:

(a) forming a reaction mixture of said metal oxide in a quantity of a liquid metal reducing agent in excess of that stoichiometrically required to fully reduce said metal oxide wherein said liquid metal reducing agent is selected from the group consisting of lithium-magnesium solutions and lithium-calcium solutions;

(b) reacting said metal oxide with said liquid metal reducing agent at a temperature below approximately 600° C. until said metal oxide has been substantially reduced to said unoxidized metal powder except for minor impurity levels of oxygen.

2. The process according to claim 1 wherein said metal oxide is an oxide of titanium.

3. The process according to claim 1 wherein said liquid metal reducing agent is a lithium-magnesium-solution.

4. The process according to claim 1 wherein said liquid metal reducing agent is a lithium-calcium solution and said metal oxide is selected from the group consisting of the oxides of the transition metals.

5. The process according to claim 4 wherein said metal oxide is selected from the group consisting of the oxides of the group IV transition metals.

6. The process according to claim 1 further comprising stirring the reaction mixture during the reaction step.

7. The process according to claim 6 further comprising the steps of:

separating said metal powder from the reaction mixture;

and cleaning said metal powder.

8. A process for reducing a metal oxide to a substantially unoxidized metal powder comprising the steps of:

(a) forming a reaction mixture of said metal oxide in a quantity of a liquid metal reducing agent in excess of that stoichiometrically required to fully reduce said metal oxide;

(b) reacting said metal oxide with said liquid metal reducing agent until said metal oxide has been substantially reduced to said unoxidized metal; and (c) distilling excess metal reducing agent from the substantially reduced metal.

9. The process according to claim 8 wherein said metal oxide is an oxide of titanium.

10. The process according to claim 8 wherein said reacting step is performed at a temperature below approximately 600° C.

11. The process according to claim 10 wherein said liquid metal reducing agent is selected from the group consisting of lithium-magnesium solutions and lithium-calcium solutions.

12. The process according to claim 8, further comprising stirring of the reaction mixture during the reacting step.

13. The process according to claim 12 further comprising the steps of:

separating said metal powder from said reaction mixture;

and cleaning said metal powder.

14. A process for reducing a metal oxide to a substantially unoxidized metal powder comprising the steps of:

(a) forming a reaction mixture of a titanium oxide powder in a quantity of liquid metal reducing agent in excess of that stoichiometrically required to fully reduce said metal oxide wherein said liquid metal reducing agent is selected from the group consisting of lithium-calcium solutions and lithium-magnesium solutions;

(b) reacting said titanium oxide with said liquid metal reducing agent at a temperature between approximately 350° and 600° C. under an inert atmosphere until said titanium oxide has been substantially reduced to the unoxidized metal;

(c) vacuum distilling excess liquid metal reducing agent from the substantially reduced titanium;

(d) stirring said reaction mixture during said reacting and distilling steps;

(e) leaching metal reducing agent oxide and any remaining metal reducing agent out of said titanium;

(f) washing the resulting titanium metal powder in water; and (g) drying said powder.

15. The process according to claim 14 further comprising:

reclaiming and recycling the metal reducing agent separated out during distillation and leaching.

* * * * *